US005295751A

United States Patent [19]

Sasaki

[11] Patent Number: 5,295,751

[45] Date of Patent: Mar. 22, 1994

[54] PRINTER HAVING ELASTIC WHEEL CASSETTE HOLDERS

[75] Inventor: Toyonori Sasaki, Anjo, Japan

[73] Assignee: Brother Kogyo Kabushiki Kaisha, Nagoya, Japan

[21] Appl. No.: 977,879

[22] Filed: Nov. 17, 1992

[30] Foreign Application Priority Data

Nov. 20, 1991 [JP] Japan ..... 3-103624

[51] Int. Cl.[5] ..... B41J 1/00

[52] U.S. Cl. ..... 400/144.2; 400/175

[58] Field of Search ..... 400/144.2, 139, 140, 400/141, 141.1, 142, 143, 144, 144.1, 144.3, 144.4, 145, 145.1, 145.2, 175

[56] References Cited

U.S. PATENT DOCUMENTS

| | | | |
|---|---|---|---|
| 4,678,352 | 7/1987 | Kittel et al. | 400/144.2 |
| 4,705,416 | 11/1987 | Asakura | 400/144.2 |
| 4,747,710 | 5/1988 | Iwata et al. | 400/144.2 |
| 4,778,289 | 10/1989 | Boella et al. | 400/144.2 |
| 4,820,066 | 4/1989 | Link | 400/144.2 |
| 4,983,055 | 1/1991 | Iwata | 400/144.2 |
| 5,004,360 | 4/1991 | Ahn | 400/144.2 |
| 5,015,107 | 5/1991 | Harada et al. | 400/144.2 |
| 5,092,691 | 3/1992 | Iwata | 400/144.2 |

*Primary Examiner*—Edgar S. Burr
*Assistant Examiner*—John S. Hilten
*Attorney, Agent, or Firm*—Oliff & Berridge

[57] ABSTRACT

A printer comprises a platen, a guide shaft extended in parallel to the platen, a carriage supported on and guided by the guide shaft for sliding movement along the platen, a wheel holder including a motor holder holding a print wheel driving motor and supported on the carriage, and a print wheel cassette held on the wheel holder. The motor holder is supported on the carriage so as to be swingable on the guide shaft or about an axis parallel to the guide shaft by a predetermined angle between a working position, adjacent to the platen to position the wheel cassette held on the wheel holder for a printing operation, and a releasing position distant from the platen to remove the wheel cassette from the wheel holder. The wheel holder is formed by bending a lower portion of the motor holder so that the wheel cassette is seated thereon. Elastic members are attached to the carriage so as to press the wheel cassette resiliently against the wheel holder when the wheel cassette is inserted in the wheel holder and the motor holder is set in place at the working position, so that the wheel cassette is restrained from free movement and vibration during printing operation.

20 Claims, 5 Drawing Sheets

PRINTER HAVING ELASTIC WHEEL CASSETTE HOLDERS

BACKGROUND OF THE INVENTION

1. Field of the Invention

The present invention relates to a printer and, more particularly, to a wheel printer incorporating improvements for preventing free movement of a wheel case containing a print wheel.

2. Description of Related Art

A wheel printer is provided, as shown in FIG. 5, with a platen 20 extended in a horizontal position, a carriage 30 supported on a guide shaft 14 parallel to the platen 20, a guide member 15 for movement along the platen 20, and a wheel cassette 36 consisting of a print wheel 34 and a wheel case 35 containing the print wheel 34. The carriage 30 carries a type striking mechanism, not shown, a ribbon cassette 37, and a wheel holder for detachably holding the wheel cassette 36. Shown also in FIG. 5 are a side frame 11, a bottom plate 12, a carriage body 31, a ribbon guide 33 and a paper guide 32.

The wheel holder will be described. A motor holder 40 holding a wheel driving motor, not shown, is supported swingably on the guide shaft 14 by a connecting plate 41 fixed thereto. A spindle 45 is supported in a sleeve 44 fixed to the motor holder 40. A gear member 43 having a gear 43*a* engaging a driving gear fixed to the output shaft of the wheel driving motor is mounted fixedly on the spindle 45. The spindle 45 has an interlocking portion 46 that engages the center hole of the print wheel 34 in its free end. The motor holder 40 has a support wall 51 for supporting the wheel case 35 at its lower end, a holding wall 49 for pressing the wheel case 35 with a rubber presser 48 that comes into contact with the front surface of the wheel case 35, and positioning walls, not shown, to position the wheel case 35 with respect to the horizontal direction. The ribbon guide 33 has a contact protrusion 50 that touches an upper portion of the back surface of the wheel case 35. The carriage body 31 has a back wall 100 having a positioning portion 101. The support wall 51 of the motor holder 40 snaps over the positioning portion 101 when pivoted into a work position as shown in dotted lines in FIG. 5. The back surface of the wheel case 35 is spaced from the back wall 100 of the carriage body 31.

To enable the wheel cassette 36 to be inserted in and removed from the wheel holder, the motor holder 40 and the associated parts can be shifted between a working position indicated by dot-dash-dot lines in the lower portion of FIG. 5 to hold the wheel cassette 36 for printing and a releasing position indicated by alternate long and two short dashed lines in the upper portion of FIG. 5. The cassette shown in solid lines is shown in a partially inserted position. The motor holder 40 is turned away from the platen 20 by an angle of about 20° on the guide shaft 14 to shift the same from the working position to the releasing position. The wheel cassette 36 can be inserted in or removed from the wheel holder with the motor holder 40 positioned at the releasing position. A plate spring 102 is attached to the lower end of the paper guide 32 to bias the wheel case 35 resiliently toward the motor holder 40 to restrain the wheel case 35 from free movement and vibration.

Without the plate spring 102, the wheel case 35 is caused to play or vibrate by vibrations generated by the rotation of the print wheel 34 and the movement of the carriage 30 because the upper portion of the wheel case 35 is held between the holding wall 49 and the contact protrusion 50, and a small gap is formed between the lower portion of the back surface of the wheel case 35 and the positioning portion 101 of the back wall 100.

Although the play and vibration of the wheel case 35 during printing operation can be prevented by the plate spring 102, the lower portion of the wheel cassette 36 is biased excessively toward the front, i.e., toward the motor holder 40, by the plate spring 102 as indicated by continuous lines in inserting the wheel cassette 36 in the wheel holder, and the upper end of the ribbon guide 33 touches the wheel case 35 as shown in FIG. 5 to impede the movement of the wheel cassette 36.

SUMMARY OF THE PRESENT INVENTION

Accordingly, it is an object of the present invention to provide a printer capable of preventing the play of the wheel case and of enabling the wheel cassette to be mounted smoothly thereon.

In one aspect of the present invention, a printer comprises a housing, a platen, a guide shaft parallel to the platen, a carriage supported on and guided by the guide shaft for movement along the platen and carrying a wheel holder, and a wheel cassette consisting of a print wheel and a wheel case containing the print wheel and detachably held on the wheel holder. The printer is characterized in that the wheel holder includes a motor holder holding a print wheel driving motor for rotating the print wheel which is supported so as to be swingable on the guide shaft or about an axis parallel to the guide shaft. The motor holder can be turned by a predetermined angle about the axis between a working position adjacent to the platen to position the wheel cassette for a printing operation and a releasing position distant from the platen. The motor holder has, at its lower end, a support wall for supporting the wheel case at its lower end, and the carriage is provided with elastic members for resiliently pressing the wheel case against the wheel holder. The elastic members are also capable of being pushed toward the platen by the support wall so that the same will not interfere with the wheel case.

Thus, the printer is provided with the motor holder supporting the print wheel driving motor and mounted on the carriage so as to be swingable on the guide shaft or about an axis parallel to the guide shaft between the working position and the releasing position, and the motor holder is provided at its lower end with the support wall for supporting the wheel case at its lower end.

The elastic members provided on the carriage touch the surface of the wheel case on the side of the platen to press the wheel case resiliently against the wheel holder when the motor holder is positioned at the working position, to restrain the wheel case from free movement and vibration. The elastic members are pushed toward the platen by the support wall when the motor holder is positioned at the releasing position so that the elastic members will not interfere with the wheel case. Accordingly, the wheel cassette can be smoothly inserted in the wheel holder without being impeded by the elastic members.

As stated above, the motor holder capable of being shifted between the working position and the releasing position, the support wall formed at the lower end of the motor holder, and the elastic members attached to the carriage prevent the free movement and vibration of the wheel case during printing operation and enables the wheel cassette to be inserted smoothly in the wheel holder without being impeded by the elastic members.

BRIEF DESCRIPTION OF THE DRAWINGS

The above and other objects, features and advantages of the present invention will become more apparent from the following description taken in connection with the accompanying drawings, in which.

DESCRIPTION OF PREFERRED EMBODIMENT

Figure 1:
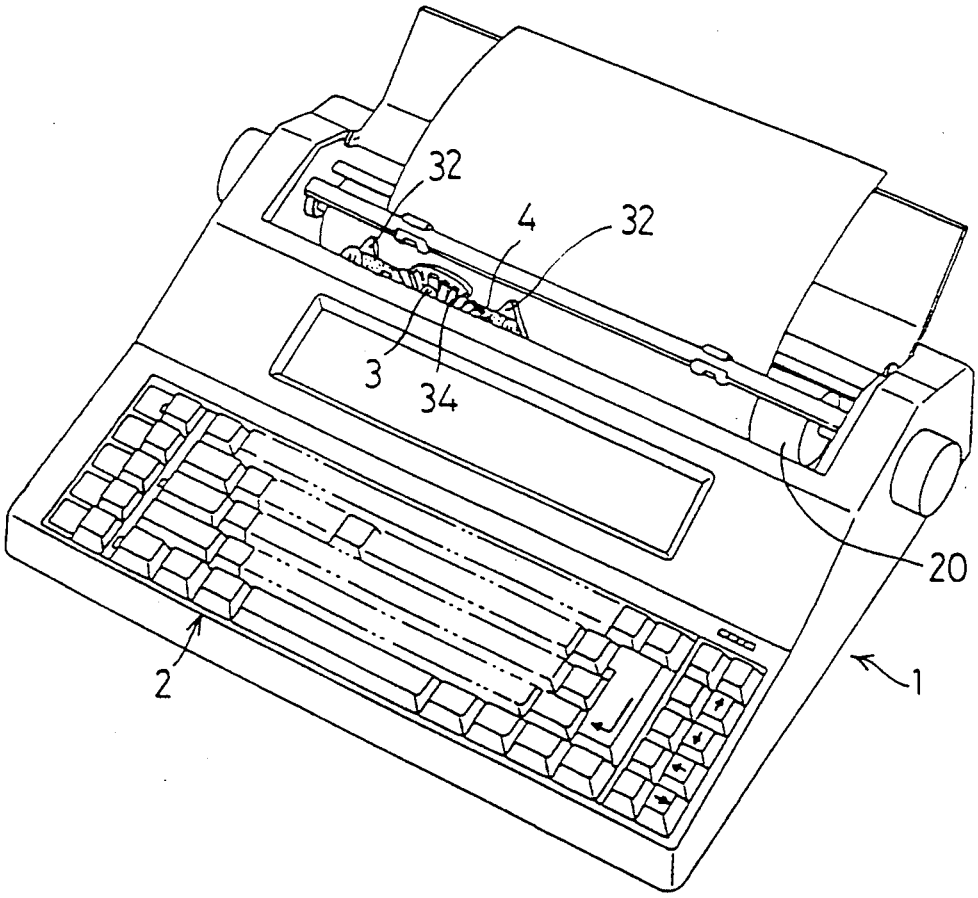
FIG. 1 is a perspective view of a typewriter embodying the present invention.

The present invention will be described hereinafter as applied to a typewriter with reference to FIGS. 1 to 4, in which only the components of the typewriter relating with the present invention are shown and indicated by reference characters in FIGS. 1 to 4 and will be described. The rest of the components similar to those of prior art typewriters are not shown and the description thereof will be omitted.

Figure 2:
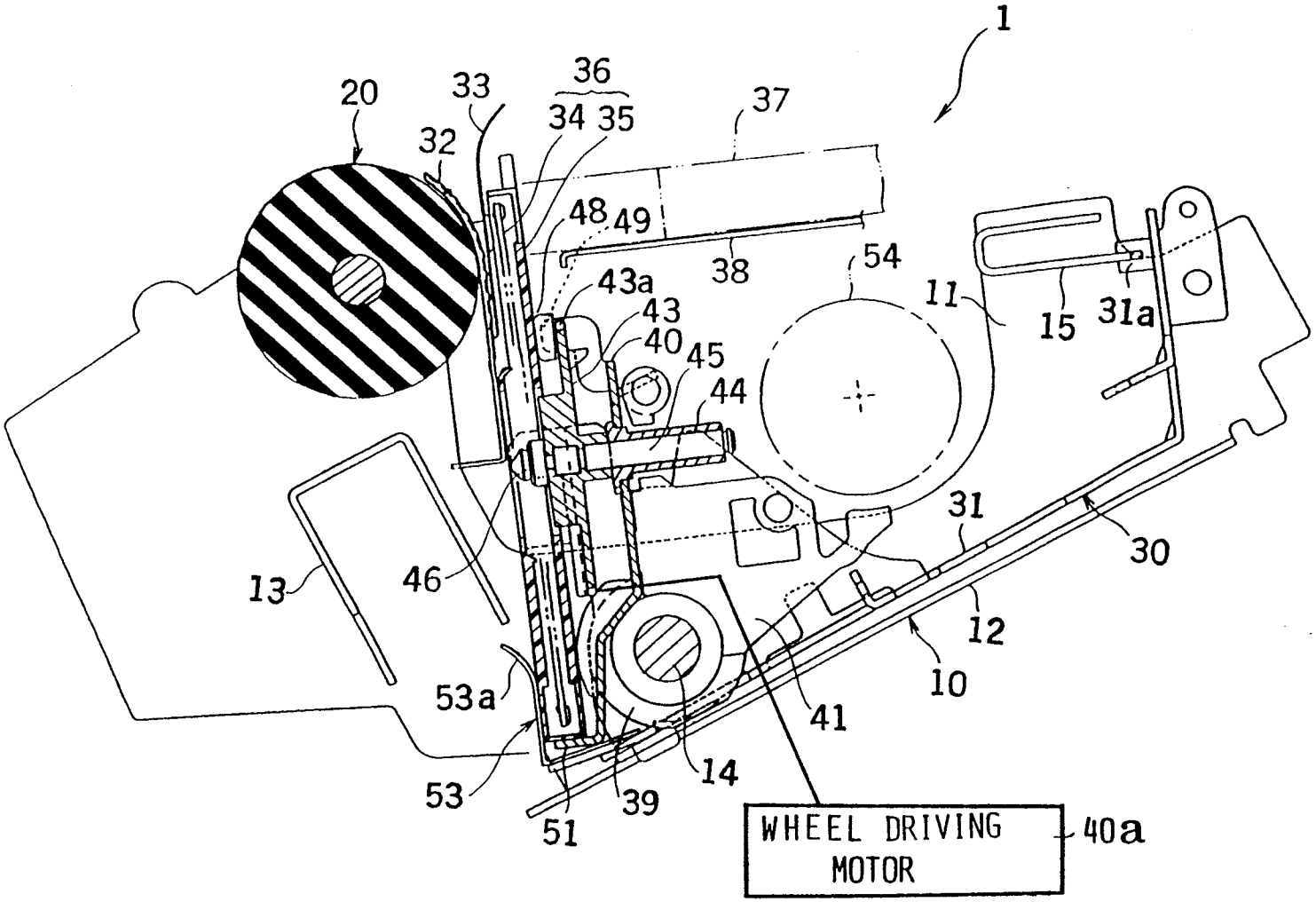
FIG. 2 is a side sectional view of an essential portion of the typewriter of FIG. 1 in a working state.

Referring to FIGS. 1 and 2, a wheel typewriter 1 comprises a main frame 10, a platen 20, a platen driving mechanism, a sheet feed mechanism, a carriage 30, a carriage driving mechanism, a keyboard 2 and a control unit. The main frame 10 consists of a pair of side frames 11, a bottom plate 12 extended between the pair of side frames 11, and a connecting frame 13 interconnecting the side frames 11. The platen 20 is supported on the pair of side frames 11. A guide shaft 14 is supported on the pair of side frames 11 in parallel to the platen 20 in a lower region of a space extending in front of the plate 20. A guide member 15 is supported on the pair of side frames 11 in parallel to and at a distance from the platen 20.

The platen 20 is extended horizontally and is joined at its opposite ends on the pair of side frames 11 so as to be driven for rotation by the platen driving mechanism. A paper guide 32 is fixed to the carriage body 31 of the carriage 30 so as to face the platen 20. A pair of ribbon guides 33 are fastened to the front surface of the paper guide 32.

Figure 4:
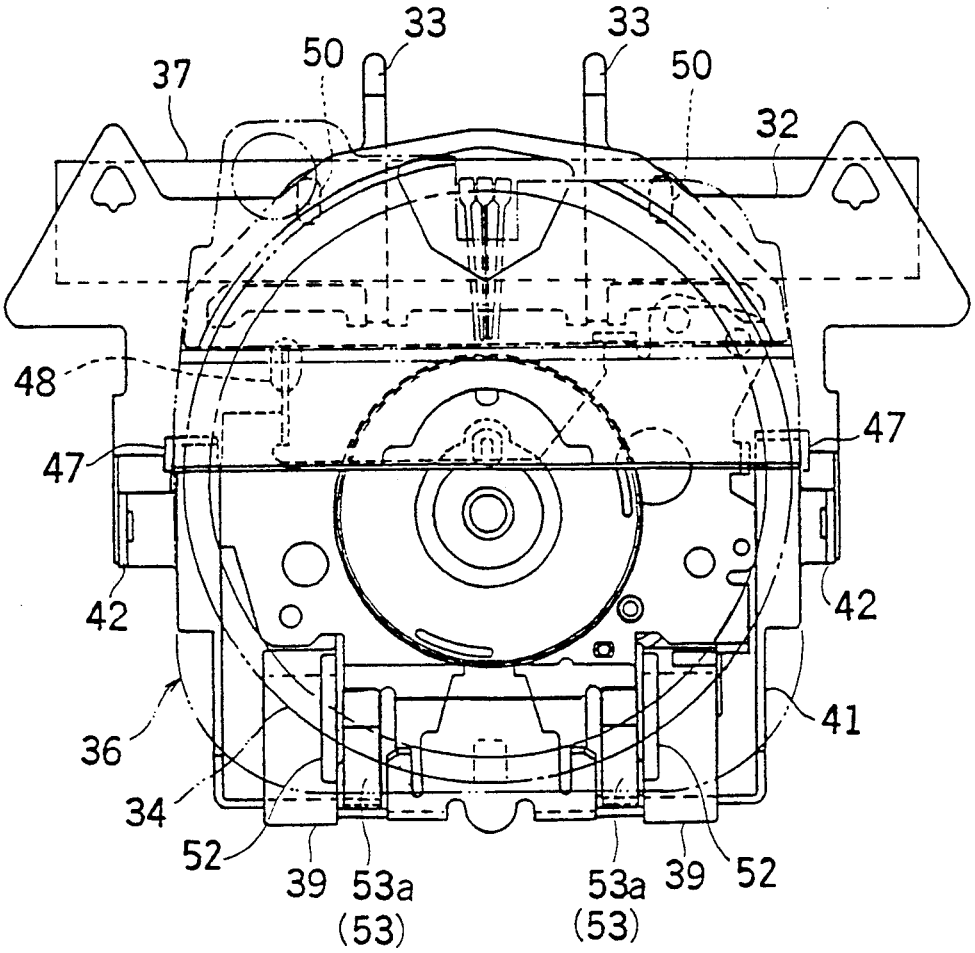
FIG. 4 is a rear view of a printing unit included in the typewriter of FIG. 1.
Figure 5:
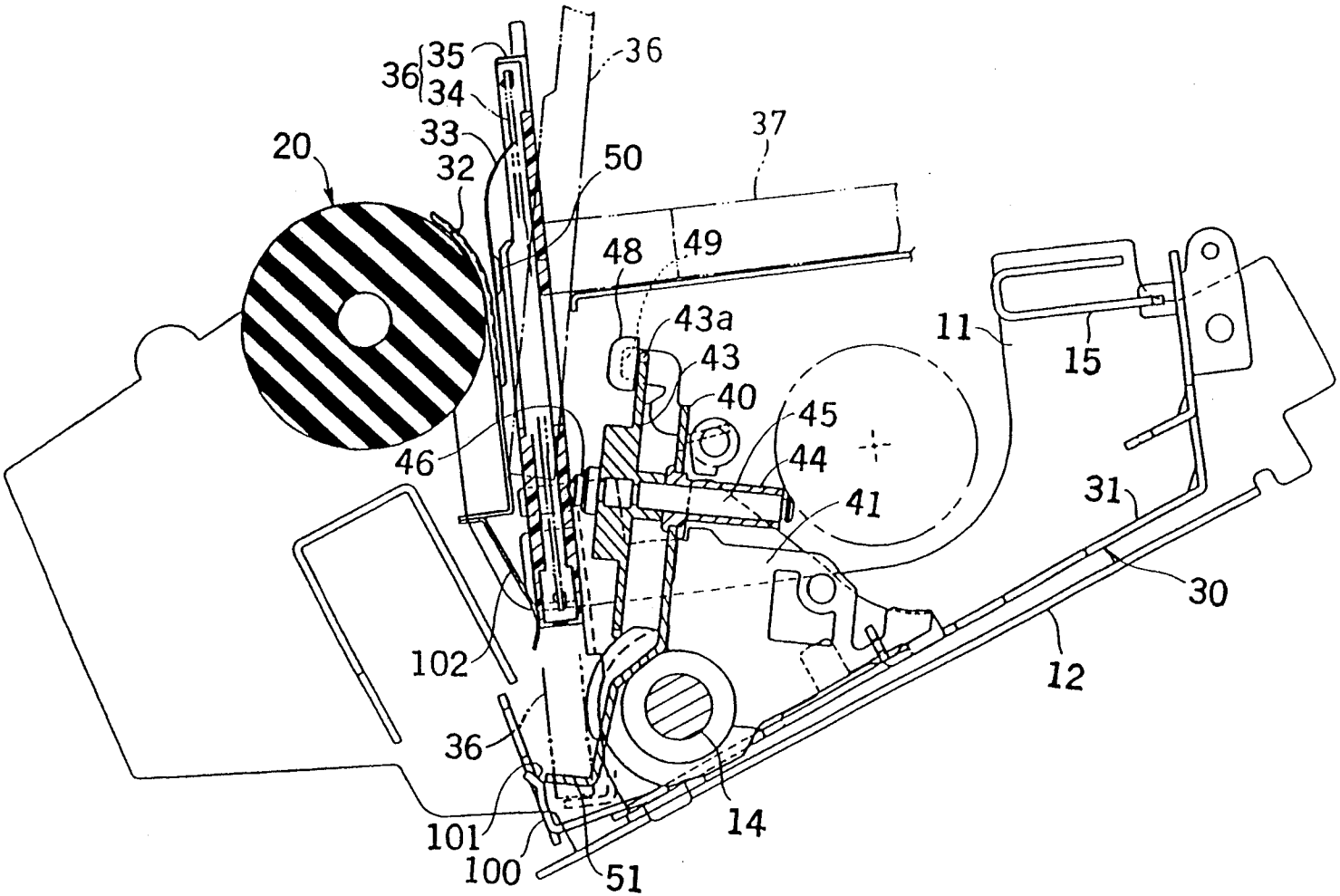
Fig.5 RELATED ART
FIG. 5 is a sectional view, similar to FIG. 3, of a prior art printer.

The carriage body 31 is supported on the guide shaft 14 and the guide member 15 for movement along the guide shaft 14. The carriage 30 carries a wheel cassette 36 consisting of a print wheel 34 and a wheel case 35, a wheel holder for holding the wheel cassette 36, a wheel driving motor 40*a* for driving the print wheel 34, a hammer type striking mechanism including a printing hammer 3 for striking the print wheel 34, an ink ribbon cassette 37 containing an ink ribbon 4, a swingable cassette holder 38 supporting the ink ribbon cassette 37 and capable of shifting the position of the ink ribbon cassette 37, a cassette holder lifting mechanism for lifting up the cassette holder 38 when carrying out an erasing operation, an ink ribbon winding mechanism, an erasing ribbon, and an erasing ribbon winding mechanism. A pair of bearings 39 attached respectively to the opposite ends of the lower rear end of the carriage body 31 are put slidably on the guide shaft 14, and a pair of sliders 31*a* attached respectively to the opposite ends of the front end of the carriage body 31 engage the guide member 15 slidably so that the carriage body 31 is able to slide along the guide shaft 14 and the guide member 15. As shown in FIG. 4, the paper guide 32 is fastened to a pair of flanges 42 formed on the opposite side walls 41 of the carriage body 31, and the pair of ribbon guides 33 are fastened to the paper guide 32.

Figure 3:
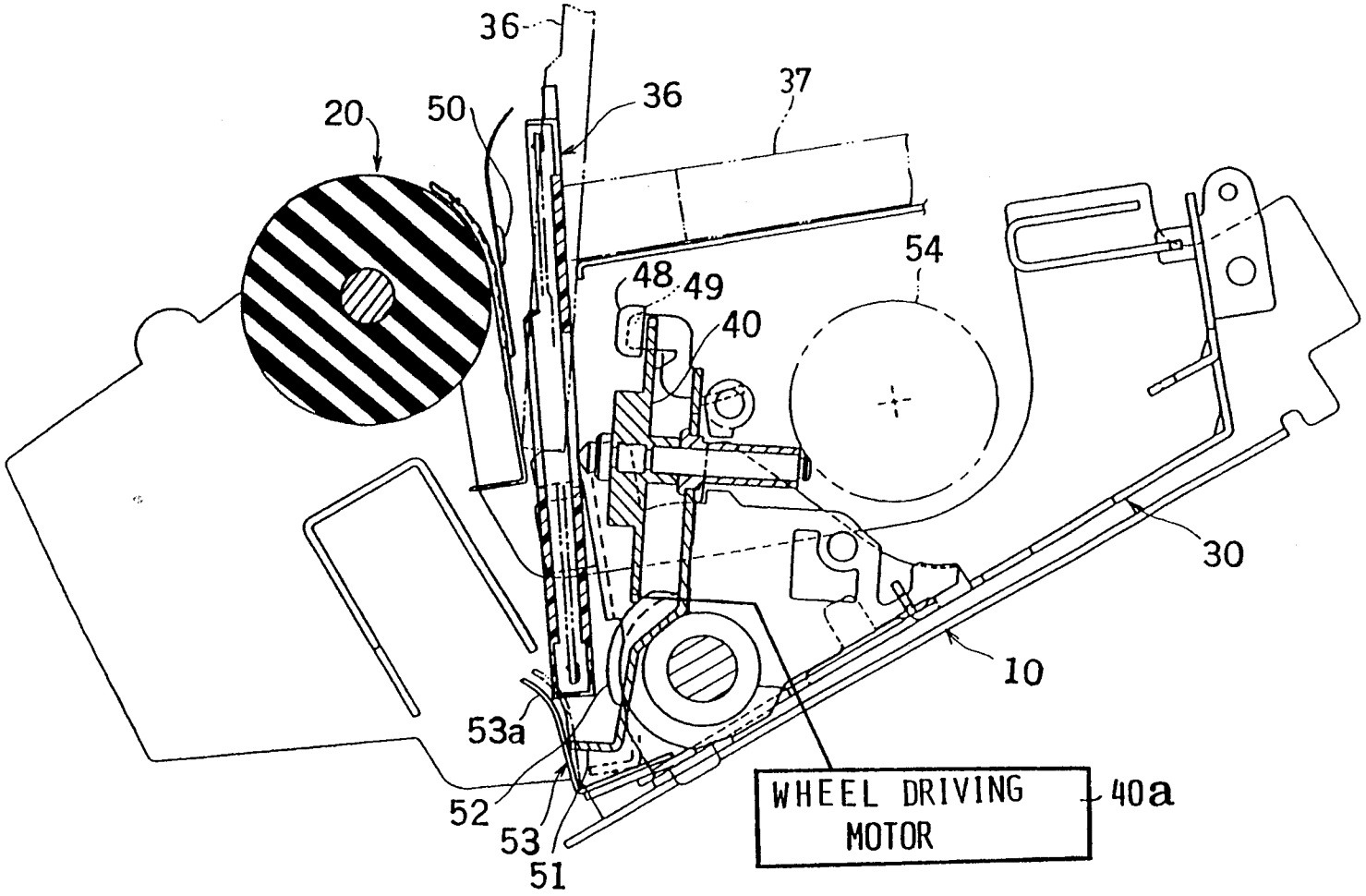
FIG. 3 is a side sectional view of the essential portion shown in FIG. 2 in a wheel releasing state.

The wheel holder will be described hereinafter. A pair of connecting plates 41 are fastened respectively to the opposite ends of the motor holder 40. Bearing members 39 fixed to the lower ends of the connecting plates 41 are put slidably on the guide shaft 14. The motor holder 40 and the associated members can be turned by an angle of about 20° between a working position adjacent to the platen 20 to hold the wheel cassette 36 at a printing position as shown in FIG. 2 and a releasing position distant from the platen 20 as shown in FIG. 3. A gear member 43 is disposed near the front side of the upper portion of the motor holder 40. The gear member 43 is provided with gear teeth 43*a* engaging teeth of a driving pinion attached to the output shaft of the wheel driving motor 40*a* as shown schematically in FIG. 2. A sleeve 44 is fastened to the motor holder 40, a spindle 45 is supported in the sleeve 44 for rotation, the gear member 43 is fixed to the spindle 45, and the front end 46 of the spindle 45 engages the center hole of the print wheel 34 so that the print wheel 34 is unable to turn relative to the spindle 45.

As shown in FIG. 4, respective portions of the side walls 41 of the carriage body 31 are raised to form positioning lugs 47 which touch the opposite side edges of the wheel cassette 36 to set the wheel cassette 36 in place for printing. A pressing lug 49 is formed in a left-hand portion of the upper end of the motor holder 40 as viewed in FIG. 4 and a rubber member 48 is secured to the pressing lug 49 so as to be in contact with the front surface of the wheel cassette 36. A pair of protrusions 50 are formed respectively in the front surfaces of the pair of ribbon guides 33. The protrusions 50 touch upper portions of the back surface of the wheel cassette 36 when the wheel cassette 36 is set in place on the carriage 30. The lower end of the motor holder 40 is bent in the shape of the letter L to form a support wall 51 on which the wheel cassette 36 is seated. A pair of ridges 52 are formed respectively on the outer surfaces of the pair of bearing members 39 so as to touch portions of the front surface of the wheel cassette 36 to hold the wheel cassette 36 in place.

A pair of plate springs 53 having a shape substantially resembling the letter L, i.e., elastic members for preventing the free movement and vibration of the wheel cassette 36 during printing operation, are fixed to the rear end of the carriage body 31. The upper ends of the upright portions 53*a* of the plate springs 53 are curved backward to guide the lower end of the wheel cassette 36 toward the front when the wheel cassette 36 is inserted in the wheel holder. When the motor holder 40 and the parts held thereon are shifted to the releasing position, the upright portions 53*a* of the plate springs 53 are bent backward by the support wall 51 as shown in FIG. 3, so that the wheel cassette 36 can be inserted in and removed from the wheel holder without being impeded by the plate springs 53. When the motor holder 40 and the parts held thereon are shifted to the working position, the plate springs 53 press the wheel cassette 36 resiliently against the motor holder 40 as shown in FIG. 2 to prevent the free movement and vibration of the wheel cassette during printing operation.

The operation of the typewriter 1 thus constructed will be described hereinafter.

In the working state shown in FIG. 2, the motor holder 40 and the parts held thereon are positioned at the operating position. In this state, the wheel cassette 36 is held in place by the support wall 51 on which the wheel cassette 36 is seated, the positioning lugs 47 restraining the wheel case 35 from lateral movement, the rubber member 48 secured to the pressing lug 49 and touching the upper portion of the front surface of the wheel case 35, and the pair of protrusions 50 touching the upper portions of the back surface of the wheel case 35. The upright portions 53*a* of the plate springs 53 press the lower portion of the wheel cassette 36 against the motor holder 40, so that the wheel cassette 36 is unable to move free or vibrate during printing operation.

When removing the wheel cassette 36 from the carriage 30, the motor holder 40 and the parts held thereon are shifted to the releasing position as shown in FIG. 3, and then, the wheel cassette 36 is removed from the carriage 30. When the motor holder 40 is shifted to the releasing position, the upright portions 53*a* of the plate springs 53 are bent backward by the support wall 51 formed on the lower end of the motor holder 40. Accordingly, the wheel cassette 36 can be removed from the carriage 30 without being impeded by the plate springs 53. When the motor holder 40 and the parts held thereon are shifted to the working position as shown in FIG. 2, the support wall 51 is separated from the upright portions 53*a* of the plate springs 53, so that the plate springs 53 are able to press the wheel cassette 36 resiliently against the motor holder 40. In the state shown in FIG. 2, the motor holder 40 is held in place by a locking mechanism, not shown.

The mechanisms mounted on the carriage 30 of the typewriter, including the hammer type striking mechanism, the ribbon feed mechanism, the erasing ribbon winding mechanism and the ribbon holder lifting mechanism are known mechanisms. In a printer proposed previously by the applicant of the present patent application in U.S. patent application Ser. No. 07/832,043, filed on Feb. 6, 1992 (Related Japanese Pat. Application No. 3-100416, filed on Apl. 4, 1991), now U.S. Pat. No. 5,171,094, a hammer type striking mechanism, a ribbon feed mechanism, an erasing ribbon winding mechanism and a ribbon holder lifting mechanism are driven by a single stepping motor 54 as shown in FIGS. 2 and 3. Although the motor holder 40 of the typewriter embodying the present invention is turned on the guide shaft 14, the motor holder 40 may be turned about an axis parallel to the guide shaft 14.

While the invention has been described in its preferred form with a certain degree of particularity, obviously many changes and variations are possible therein. It is therefore to be understood that the present invention may be practiced otherwise than as specifically described herein without departing from the scope and spirit thereof as defined in the appended claims.

I claim:

1. A printer comprising:

a housing;

a platen coupled to said housing and supporting a sheet;

a guide shaft coupled to said housing, spaced from and parallel to said platen;

a carriage supported on and guided by said guide shaft, said carriage moving along said platen;

a wheel cassette including a print wheel and a wheel case containing said print wheel, said wheel case having an upper edge and a lower edge;

a wheel holder supported on and carried by said carriage and detachably holding said wheel case with said upper edge adjacent said platen, said wheel being shiftable between a work position and a release position and comprising a print wheel driving motor rotating said print wheel and a motor holder holding said print wheel driving motor, said motor holder having a support wall supporting said wheel case; and at least one elastic member secured to said carriage engaging said lower edge of said wheel case and pressing said wheel case against said wheel holder when said wheel holder is shifted to said work position, and wherein said elastic member is bent by said wheel holder so that said wheel cassette can be inserted in and removed from said wheel holder when said wheel holder is shifted to said release position.

2. The printer according to claim 1, wherein said at least one elastic member is positioned adjacent said support wall.

3. The printer according to claim 1, wherein said at least one elastic member comprises a pair of spaced elastic members.

4. The printer according to claim 1, wherein said at least one elastic member is an L-shaped plate spring.

5. The printer according to claim 1, wherein said at least one elastic member is a plate spring with a curved portion and said curved portion presses against said wheel case.

6. The printer according to claim 1, further comprising a paper guide assembly coupled to said carriage and guiding the sheet against said platen, said paper guide being spaced and independent from said at least one elastic member.

7. The printer according to claim 1, wherein said motor holder is pivotally coupled to said guide shaft and moves between a work position in which said wheel cassette is adjacent said platen and a releasing position in which said wheel cassette is spaced from said platen.

8. The printer according to claim 7, wherein said motor holder pivots about 20 degrees between said work position and said releasing position.

9. The printer according to claim 1, wherein said motor holder comprises a body and a holding wall extending outwardly therefrom and pressing against said wheel case, said support wall being spaced from said holding wall and extending outwardly from said body.

10. The printer according to claim 9, further comprising a ribbon guide carried by said carriage and having a protrusion which contacts said wheel case on an opposite side than said holding wall and presses said wheel case against said wheel holder.

11. The printer according to claim 1, further comprising a print hammer supported by said carriage and impacting said print wheel.

12. The printer according to claim 1, further comprising a spindle with an interlocking portion on an end thereof and engaging said print wheel, a sleeve supporting said spindle and secured to said motor holder, and a gear fixedly mounted to said spindle and engaging a driving gear of said wheel driving motor.

13. A printer comprising:

a housing;

a platen coupled to said housing and supporting a sheet;

a guide shaft coupled to said housing, spaced from and parallel to said platen;

a carriage supported on and guided by said guide shaft, said carriage moving along said platen;

a wheel cassette including a print wheel and a wheel case containing said print wheel, said wheel case having a front surface, a back surface and an outer peripheral edge;

a wheel holder supported on and carried by said carriage detachably holding said wheel cassette, said wheel holder having a support wall supporting said wheel case at said outer peripheral edge;

at least one elastic member secured to said carriage adjacent said support wall engaging said back surface of said wheel case adjacent said outer peripheral edge and pressing said front surface of said wheel case against said wheel holder; and wherein said elastic member is a plate spring.

14. The printer according to claim 13, wherein said at least one elastic member comprises a pair of spaced elastic members.

15. The printer according to claim 13, wherein said plate spring is an L-shaped.

16. The printer according to claim 13, wherein said plate spring has a curved portion and said curved portion presses against said back surface of said wheel case.

17. The printer according to claim 13, further comprising a paper guide assembly coupled to said carriage guiding the sheet against said platen, said paper guide assembly being spaced and independent from said at least one elastic member.

18. The printer according to claim 13, wherein said wheel holder comprises a motor holder which is pivotally coupled to said guide shaft to move between a work position in which said wheel cassette is adjacent said platen and a releasing position in which said wheel cassette is spaced from said platen.

19. The printer according to claim 13, wherein said wheel holder comprises a body and a holding wall extending outwardly therefrom and pressing against said front surface of said wheel case, said support wall being spaced from said holding wall and extending outwardly from said body.

20. The printer according to claim 13, further comprising a ribbon guide carried by said carriage and having a protrusion which contacts said back surface of said wheel case and presses said wheel case against said wheel holder.

* * * * *